US005376763A

United States Patent [19]

Watarai

[11] Patent Number: 5,376,763

[45] Date of Patent: Dec. 27, 1994

[54] ROTARY KEY SWITCH WITH HEAD DISSIPATING REDUNDANT TERMINAL PLATE

[75] Inventor: Nobuo Watarai, Miyazaki, Japan

[73] Assignee: Kabushiki Kaisha Honda Lock, Miyazaki, Japan

[21] Appl. No.: 126,939

[22] Filed: Sep. 24, 1993

[30] Foreign Application Priority Data

May 14, 1993 [JP] Japan ..... 5-30620[U]

[51] Int. Cl.[5] ..... H01H 19/58; H01H 9/52

[52] U.S. Cl. ..... 200/11 C; 200/43.08; 200/289; 361/704

[58] Field of Search ..... 200/11 R, 11 C, 11 G, 200/11 J, 11 K, 43.08, 283, 284, 289, 304, 305; 361/688, 704, 707, 709, 710, 711, 712

[56] References Cited

U.S. PATENT DOCUMENTS 4,868,352 9/1989 Botz et al. ..... 200/4
4,975,549 12/1990 Krubsack et al. ..... 200/11 C
4,983,947 1/1991 Mullen et al. ..... 340/426
5,252,791 10/1993 Williams ..... 200/11 C
5,289,177 2/1994 Wake ..... 340/825.31

*Primary Examiner*—J. R. Scott
*Attorney, Agent, or Firm*—Skjerven, Morrill, MacPherson, Franklin, & Friel

[57] ABSTRACT

Provided is an improved key switch for vehicles which can control the generation of heat from the contacts without increasing the size of the switch structure itself. The key switch may comprise a rotor, which rotates in accordance with the insertion and rotation of a key, a plurality of fixed contacts provided in a terminal support plate, a plurality of moveable contacts carried by the rotor which cooperate with the fixed contacts according to the angular position of the rotor, and a plurality of terminal plates for connecting the fixed contacts to onboard electric equipment and an onboard battery via a coupler. The terminal plates include a redundant or idle terminal plate which is commonly connected to the terminal plate for power supply, and promotes the dissipation of heat from the terminal plate for power supply, and increases the rigidity of the structure for supporting the coupler.

4 Claims, 2 Drawing Sheets

ROTARY KEY SWITCH WITH HEAD DISSIPATING REDUNDANT TERMINAL PLATE

TECHNICAL FIELD

The present invention relates to a key switch for vehicles that turns the onboard power source on and off and activates the starter motor.

BACKGROUND OF THE INVENTION

Recent automobiles have been equipped with numerous pieces of electric equipment such as air conditioners, audio units, power seats, and power windows. The power consumption tends to increase due to such an electric load. Therefore, the electric current flowing through the contacts for the key switch that controls the supply of electric power to such onboard electric equipment tends to be increased. In particular, activation of the starter motor involves a substantial amount of electric current, which results in significant heat generation from the contacts of the key switch. Such heat generation is not desirable because it accelerates the deterioration of the plastic materials used for the holder members and the couplers that secure the contact terminals.

To control the heat generation of the contacts, it is necessary to increase the heat capacity of the contacts, but, because such contacts are generally enclosed for the needs of electric insulation the generated heat cannot be readily removed. When an attempt is made to increase the heat capacity of the contacts, the size of the key switch inevitably becomes larger.

BRIEF SUMMARY OF THE INVENTION

In view of such problems of the prior art, a primary object of the present invention is to provide an improved key switch for vehicles which can favorably control the heat generation from the contacts without increasing the size of the switch itself.

A second object of the present invention is to provide a key switch for vehicles which can increase the rigidity of its electric coupler in a convenient way.

According to the present invention, these and other objects can be accomplished by providing a key switch for vehicles comprising: a key rotor, which is rotatably supported in a casing and which is provided with a slot for receiving a key; and a rotary switch assembly including: a switch rotor, which is rotatably supported in the casing for rotation in synchronism with the key rotor, moveable contacts made of electrically conductive material and carried by the switch rotor via electric insulating means, fixed contacts made of electrically conductive material and supported by a terminal support plate made of electrically insulating material, for cooperation with the moveable contacts, terminal plates made of electrically conductive material and extending from the fixed contacts, and coupler means provided at a terminal end of the terminal plates for establishing an electric connection of the terminal plates to an external circuit; the terminal plates including a redundant terminal plate which is commonly connected to one of the terminal plates for conducting electric current supplied from an onboard battery.

According to this structure, the surface area of the idle or redundant terminal, extending between the coupler means and the fixed contact set, contributes to the surface area for heat dissipation; the efficiency of heat removal from the contacts can thus be improved without increasing the size of the key switch structure. Furthermore, the redundant terminal readily contributes to the increase in the rigidity of the coupler means without requiring any additional support structure for the coupler means. This is important in the application to vehicles which are often subject to severe vibration.

In particular, if the fixed contacts include a redundant contact which is securely supported by the terminal support plate and connected to the redundant terminal plate, then the redundant terminal can be supported in a secure and reliable manner, and can more effectively increase the rigidity of the coupler means that is connected to the redundant terminal plate. Of course, the redundant contact may not be actually redundant in the sense of actual need. It is often desirable to have two or more common fixed contacts for power supply in the rotary switch assembly for the convenience of the mechanical and electric design of the rotary switch assembly.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
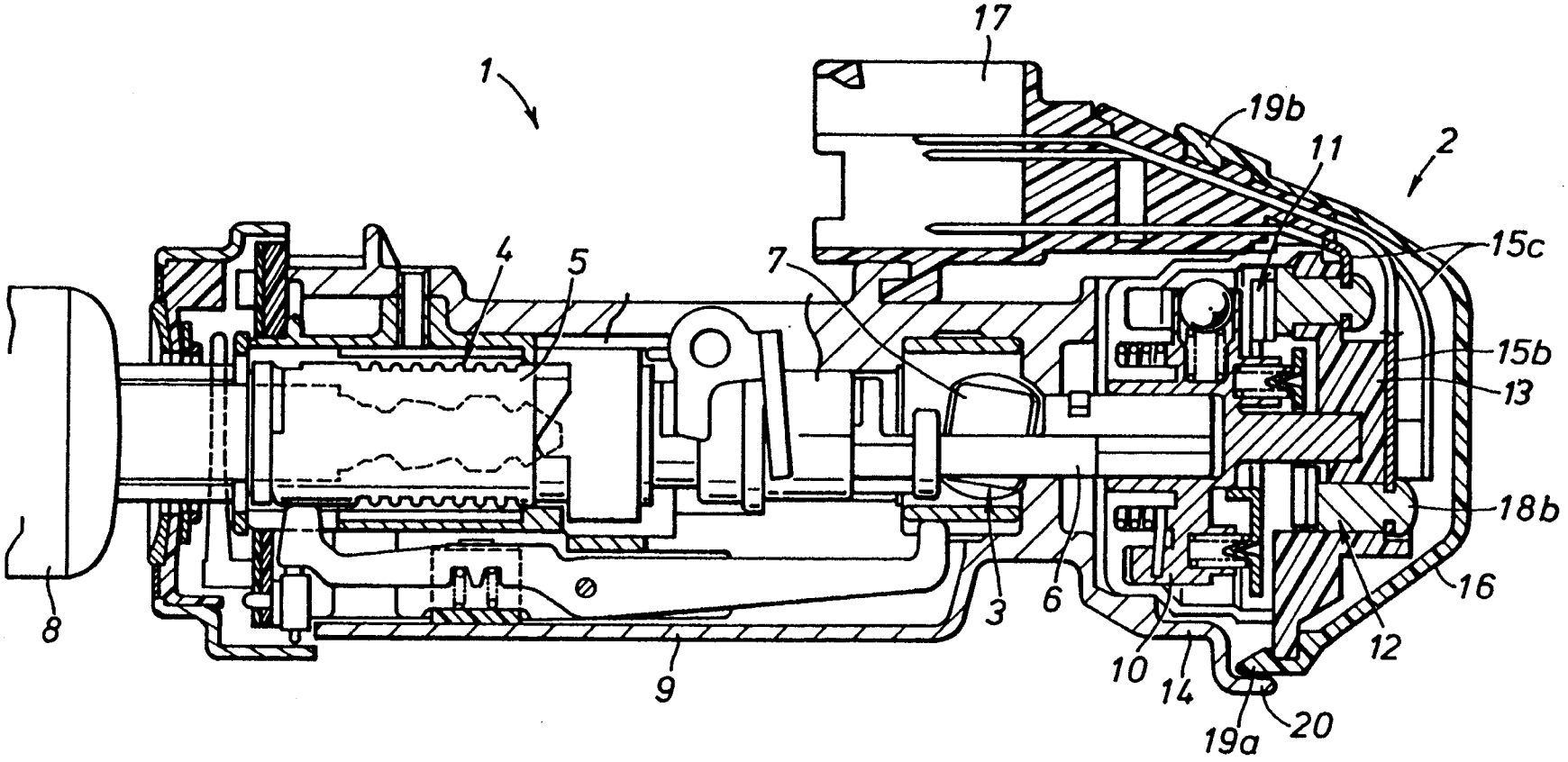
FIG. 1 is a sectional side view of the key device to which the present invention is applied.

FIG. 1 generally illustrates the structure of a key device constructed according to the present invention. This key device 1 is adapted to be mounted on a steering column that surrounds a steering shaft of an automobile. It consists of a rotary switch assembly 2, a steering lock assembly 3, and a cylinder lock assembly 4, for providing the functions of turning on and off the onboard power source and starter motor, as well as the function of locking the steering system. In this key device 1, a rotor 5 of the cylinder lock assembly 4 and the rotary switch assembly 2 are connected via a coupling shaft 6. An eccentric shaft portion provided in an intermediate part of the coupling shaft 6 engages with a lock pin 7. Inserting a key 8 in the rotor 5 of the cylinder lock assembly 4, and turning it, causes the contacts provided in the rotary switch assembly 2 to be turned on and off while the lock pin 7 is moved between a position for engagement with the steering shaft, and a position for disengagement therefrom.

The rotary switch assembly 2 consists of: a switch rotor 10, which rotates in synchronism with the rotation of the key 8; a terminal support plate 13 carrying a fixed contact set 12 which can cooperate with a movable contact set 11 which is carried by the switch rotor 10; a switch casing 14 formed in the rear end of a main body casing 9 of the key device for accommodating the switch rotor 10 therein; a terminal plate cover 16 which covers connecting terminal plates 15 soldered to the fixed contact set 12 at their base ends; and a coupler half 17, which is fixedly secured to the free ends of the connecting terminal plates 15.

The connecting terminal plates 15, which are soldered to the fixed contact set 12 at their base ends, and fixedly fitted into the coupler half 17 at their free ends so as to be electrically connected to the associated electric equipment and power source via the coupler half 17. More specifically, this coupler half 17 is adapted to be connected to the other coupler half (not shown in the drawing) which is in turn connected to a wire harness, bundling the lead wires from the onboard equipment and the onboard battery. The state of contact between the movable contact set 11 and the fixed contact set 12 changes according to the angular position of the switch rotor 10. The electric current is selectively supplied to the selected pieces of electric equipment according to the positions of LOCK, ACC, ON, and START, in the same way that well known key switches for vehicles are.

Figure 2:
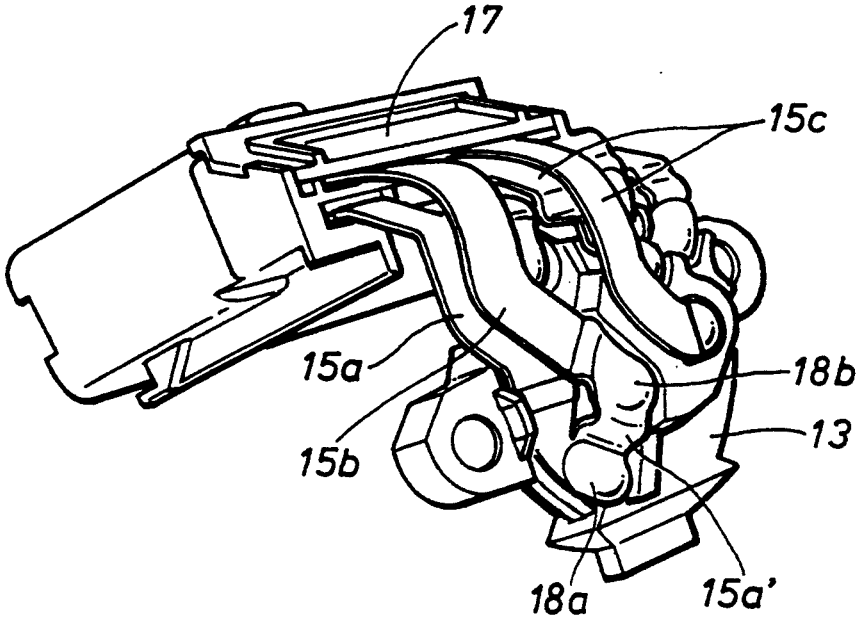
FIG. 2 is a perspective view of the rear end of the key switch.

One of the contacts 18*a* of the fixed contact set 12, which is to be connected to the battery, is soldered to the terminal plate 15*a* for power supply, and another contact 18*b* of the fixed contact set 12 is connected to the corresponding end of the idle terminal plate 15*b*. An extension 15*a*'of the terminal plate 15*a* commonly connects the mentioned fixed contacts 18*a* and 18*b* with each other by being soldered to the terminal plate 15*b* or to the contact 18*b*, as best illustrated in FIG. 2. As a result, the effective surface area of the terminal plate to which electric power is supplied is sufficiently increased, and the heat generated from the contact when the electric load is connected thereto can be more efficiently dissipated. Further, since the base end of the idle terminal plate 15*b* is soldered to the fixed contact 18*b*, the terminal plate 15*b* can be securely fixed.

This idle terminal plate 15*b* can be provided in a part of the terminal support plate which is left unused; thus, as best illustrated in FIG. 2, for the provision of this idle terminal plate 15*b*, the size of the terminal support plate 13 is not required to be increased.

Although the contact 18*b* is named as idle or redundant contact, it obvious does not exclude the possibility of the contact serving a useful purpose. As a matter of fact, it is often desirable to have two or more common fixed contacts for power supply in the rotary switch unit for the convenience of the mechanical and electric design of the rotary switch assembly. Particularly in such a case, the provision of the idle terminal plate 15*b* would not interfere with the structure of the terminal support plate 13 as the redundant contact 18*b* is already in existence, and is available for connecting the idle terminal plate 15*b*.

The terminal plate cover 16, which covers the terminal support plate 13, is provided with a plurality of (in this instance four) engagement claws 19*a* and 19*b*. Three of them 19*a* engage to suitable parts of the outer periphery of the terminal support plate 13, while the remaining engagement claw 19*b* is engaged to a side face of the coupler half 17.

The rotary switch assembly 2 is fixedly secured to the rear end of the main body casing 9 of the key device, by securing the terminal support plate 13 to an associated end surface of the switch casing 14 to the terminal plate cover 16 which is already mounted.

The open end of the switch casing 14 is provided with a wall 20 at such a position that the wall 20 overlaps with the outer face of one of the engagement claws 19*a* which engages with the terminal support plate 13. As a result, once the rotary switch assembly 2 is fixedly secured to the main body casing 9 of the key device 1, the terminal plate cover 16 is prevented from deforming and thereby disengaging the engagement claw 19*a*. The possibility of exposing any parts of the terminal plates, due to inadvertent removal or disengagement of the terminal plate cover 16, can thus be avoided.

According to the present invention, there is provided an idle terminal plate 15*b* (shown in FIG. 2) which extends between the coupler half 17 and the fixed contact 18*b* provided in the terminal support plate 13, in addition to the normal terminal plate 15*a* for supplying electric current from the onboard battery, and the increased surface area and the volume of the terminal plate particularly due to the provision of the idle terminal plate 15*b* can substantially improve the capability to dissipate heat that is generated from the contact which is connected to the battery. Therefore, the heat capacity of the relevant terminal plate can be increased and generation of heat from the contacts can be favorably controlled without increasing the size of the switch structure. Furthermore, the rigidity of the coupler structure, which is supported by the terminal plates, can be substantially increased with the provision of such an idle terminal.

Although the present invention has been described in terms of a specific embodiment thereof, it is possible to modify and alter the details thereof without departing from the spirit of the present invention.

What we claim is:

1. A key switch for vehicles, comprising:

a key rotor, which is rotatably supported in a casing and which is provided with a slot for receiving a key; and a rotary switch assembly including: a switch rotor, which is rotatably supported in said casing for rotation in synchronism with said key rotor, moveable contacts made of electrically conductive material and carried by said switch rotor via electric insulating means, fixed contacts made of electrically conductive material and supported by a terminal support plate made of electrically insulating material, for cooperation with said moveable contacts, terminal plates made of electrically conductive material and extending from said fixed contacts, and coupler means provided at a terminal end of said terminal plates for establishing an electric connection of said terminal plates to an external circuit;

said terminal plates including a redundant terminal plate which is commonly connected to one of said terminal plates for conducting electric current supplied from an onboard battery.

2. A key switch for vehicles according to claim 1, wherein said fixed contacts include a fixed contact which is supported by said terminal support plate and connected to said redundant terminal plate.

3. A key switch for vehicles according to claim 1, wherein said coupler means is attached to a side portion of said casing, and said terminal plates constitute a structural part for securing said coupler means to said casing.

4. A key switch for vehicles, comprising:

a rotor, which rotates in accordance with the insertion and rotation of a key;

a plurality of contact means, which operate according to the angular position of the rotor; and a plurality of terminal plates for connecting the contact means to onboard electric equipment and an onboard battery via coupler means;

the terminal plates including a redundant idle terminal, which is connected to one of the contact means to which electric power from the onboard battery is supplied.

* * * * *

UNITED STATES PATENT AND TRADEMARK OFFICE

CERTIFICATE OF CORRECTION

PATENT NO. : 5,376,763
DATED : December 27, 1994
INVENTOR(S) : Nabuo Watarai

It is certified that error appears in the above-indentified patent and that said Letters Patent is hereby corrected as shown below:

On the title page, Item [54] and col.1, line 2, delete "HEAD" and insert --HEAT--.

Signed and Sealed this

Eighteenth Day of June, 1996

*Attest:*

*Attesting Officer*

BRUCE LEHMAN

*Commissioner of Patents and Trademarks*